United States Patent [19]

Kress et al.

[11] Patent Number: 5,062,602

[45] Date of Patent: Nov. 5, 1991

[54] DOUBLE FEEDING PREVENTION IN A BOTTOM SHEET DOCUMENT FEEDER

[75] Inventors: Glenn F. Kress; Gerald L. Coy, both of Rochester, N.Y.

[73] Assignee: Xerox Corporation, Stamford, Conn.

[21] Appl. No.: 572,279

[22] Filed: Aug. 24, 1990

[51] Int. Cl.[5] ..... B65H 3/34

[52] U.S. Cl. ..... 271/104; 271/123; 271/167

[58] Field of Search ..... 271/104, 121, 123, 124, 271/167, 168, 165

[56] References Cited

U.S. PATENT DOCUMENTS

| | | | |
|---|---|---|---|
| 3,640,524 | 2/1972 | Fredrickson | 271/121 |
| 3,895,791 | 7/1975 | Kramell et al. | 271/35 |
| 3,934,869 | 1/1976 | Strobel, Jr. | 271/35 |
| 4,259,406 | 3/1981 | Borrelli | 428/410 |
| 4,313,599 | 2/1982 | Lohr | 271/166 |
| 4,336,929 | 6/1982 | Hanzlik | 271/20 |
| 4,619,450 | 10/1986 | Anderson et al. | 271/35 |
| 4,843,436 | 6/1989 | Evangelista et al. | 355/133 |

FOREIGN PATENT DOCUMENTS

| | | | |
|---|---|---|---|
| 332179 | 7/1930 | United Kingdom | 271/104 |

OTHER PUBLICATIONS

Xerox Disclosure Journal, vol. 10, No. 4, Jul./Aug. 1985.

Xerox Serv. Manual, 914/720/420 Copiers & Accessories, pp. 1–5.

*Primary Examiner*—Richard A. Schacher

[57] ABSTRACT

A multifeed resistance system 90 which is a simple and low cost modification of known non-retard type bottom sheet separator/feeders, especially a vacuum feeder 17 in which the stack 14 of sheets is fluffed by an air knife 18 and the front area of the bottom sheet 98 is pulled down by vacuum and fed vacuum out from the bottom of the stack 14 with the corrugating vacuum belt feeder 17 and there fed out of the tray 16 from underneath the stack 14. A limited area of special multifeed resisting or retarding member 92 under the rear area of the stack 14 has been found to be effective in resisting multifeeds, yet not interfere with effective bottom sheet sequential feeding. One or more areas of the double feeding resistance member 92 overly the rear or upstream portion of the stack supporting bottom surface 15 of the stacking tray 16. This is an oriented (one-way) fiber mat, cloth or pad material, the fibers 94 of which are angled upstream (oriented towards the rear of the tray 16). These upstream oriented fibers 94 engage the trail or upstream edge area of the second-from-the-bottom sheet 96 to resist its downstream movement as the bottom-most sheet 98 is being initially separated and fed out.

6 Claims, 3 Drawing Sheets

DOUBLE FEEDING PREVENTION IN A BOTTOM SHEET DOCUMENT FEEDER

Cross-reference is made to a copending application of the same assignee, filed July 2, 1990 as U.S. application Ser. No. 07/ 546,984 and entitled "Dual Mode Document Registration System", disclosing the same basic exemplary document handler and electronic platen scanning system also disclosed herein.

There is disclosed herein an improved bottom sheet stack separator/feeder. This improved bottom sheet stack separator/feeder is especially suitable for an original document separator/feeder for a document imaging system or copier having an automatic document feeder into which a set of document sheets are initially stack loaded into a tray and the automatically sequentially separated and fed out for their imaging.

As shown in the cited and other art, a longstanding problem in stack separator/feeders is the separation of the bottom sheet from the other overlying sheets of the stack so that only one document sheet will be fed out for imaging at a time. It is important that double feeding be avoided, to avoid jams, misfeeds, misimaging, miscollations, etc. Double feeding (or multifeeding-the two terms can be used interchangeably here) is the feeding of two or more sheets together, unseparated. It is particularly important to avoid double feeding in the separating and feeding of documents for electronic imaging, to avoid the non-imaging of the misfed document page, since typically collated copies are made of the stored electronic images of the entire document set or stack, and they are typically printed out unattended or at a different location from the document imager, so that the document feeding error may not be noticed until after many or all of the copy sets have been finished with a missing page and miscollation of the sets. This can require recopying of all of the copy sets, and even reimaging of all the documents again, just because of one missing (double fed) document page.

There is disclosed herein an improved bottom sheet stack separator/feeder with a simple and low cost combination with and modification of known VCF type bottom separator/feeder with an oriented (one-way) fiber sheet trail edge area multifeed resisting retard member in an upstream portion of the feeder tray bottom surface. VCF is a common abbreviation for a vacuum corrugating feeder in which the stack of sheets is fluffed by an air knife and the front area of the bottom sheet is pulled out from the bottom of the stack with a corrugating vacuum belt feeder to separate it from the stack and fed it out of the tray. Such VCF feeders are preferable for document feeding since they desirably avoid using any retard pads for sheet separation, unlike conventional retard type feeders. This avoid smearing or other damage to the documents. It is especially usable with a recirculating type document handler (RDH) for an imager for a copier, printer, or other document imaging system, as discussed in the art.

Such VCF feeders heretofore have avoided or sought to reduce drag or resistance to the feeding out of the document sheet by the VCF, which was considered to interfere with the VCF functioning. However, in the present system, a particular type and limited area of application special multifeed resisting or retarding member has been found to be effective in resisting multifeeds, yet not interfere with effective bottom sheet feeding.

Merely by way of example of some patents on VCF document feeders are Xerox Corporation U.S. Pat. Nos. 4,259,406 to Hamlin, 4,336,929 to Hanzlik and 4,313,599 to Lohr. The latter particularly illustrates the attempt to reduce friction between the tray bottom and the document sheet being fed.

Some examples of retard type sheet separator/feeders include Xerox Corporation U.S. Pat. Nos. 3,895,791 to Kramell et al, and 3,934,869 to Strobel.

Oriented (one-way or angled)-fiber material pads have been commercially available for some time. These are commercial rug or cloth like materials in which the fibers or bristles are angled in one direction relative to the plane of the substrate. They have been used in certain other sheet feeding or stacking applications. It is sometimes referred to as "one-way grass." For example, it is used as a sheet lead edge impact absorbing surface on the front (downstream) vertical wall of the restacking trays of some commercial Xerox Corporation RDH's, such as the "1065" and "5090" copier RDH's, with the fiber or bristle orientation pointing downwardly to resist a tendency of a sheet being restacked to climb up that wall upon impact therewith. This is similar to the description on page 232 of the Xerox Disclosure Journal publication Vol. 10, No. 4, July/August 1985 as to the side guide wall. U.S. Pat. No. 4,619,450 to Anderson, et al is of particular interest a showing upwardly oriented fiber bristle mats engaging opposite sides of the paper stack in a bottom sheet paper feeder to resist the downward movement of the stack, i.e., to support the weight of the stack while the mats are pressure engaged. Other frictional fiber pads have been used for side of stack paper drag pads in copy paper sheet feeders such as the Xerox Corporation "914/720/420" copiers, as also shown in their service manual. U.S. Pat. No. 4,843,436 shows brush pads specially insertable into engagement with paper fed rolls for cleaning them. Other frictional pads, especially cork, are known for use on tray bottoms mounted in direct opposition to (directly under) top-of-stack paper feeding rollers, for improved feeding control over the last (bottom) sheet fed.

Although of particular utility as part of a a system for feeding a set of documents for electronic imaging, the disclosed system may also be desirably used in conventional optical (non electronic imaging) copier, especially one with a multiply recirculating document handler, as additionally disclosed herein.

In a document feeder for an electronic document imaging and printing system, a set of documents normally need only be fed to be imaged once, and electronically stored, to make any number of ultimate printed copies. Yet even for electronic document imaging a known recirculating document handler (RDH), such as cited herein, can be desirable for feeding duplex (two-sided) documents. The RDH can be used to recirculate the document set twice, with inversion during the first circulation, so as to copy both sides of the documents more rapidly or efficiently, by imaging all of the even page sides in one circulation, and then all of the odd page sides in the next circulation, in contrast to a document handler which must invert and image both sides of each document one at a time in direct sequence.

As to the disclosed exemplary recirculating document handler (RDH) or other document feeder, per se, it may desirably, with only minor modifications as described herein, be of a desirable known type. Such RDH's are well known for use with conventional optical light-lens copiers, although shown here with an electronic document scanner imaging system.

By way of background, disclosed herein by way of such example of an RDH is a well known dual input type of RDH, an RDH/SADH. RDH/SADH is a common abbreviation for a well known type of document handler with a top document loading tray recirculating document handler (RDH) mode and an integral alternative side document entrance or SADH slot providing a semi-automatic document handler (SADH) unidirectional document input. This disclosed RDH system allows documents to be automatically or semi-automatically fed onto an imaging platen from either infeeding position. Examples of patents thereon are cited below. However, this is merely exemplary, and the present invention is not limited to any particular type of recirculating or common tray restacking document handler or document feeder.

An example of such an electronic document imaging and printing system is disclosed in Xerox Corporation U.S. Pat. No. 4,757,348 issued July 12, 1988 to Rourke, et al and commonly filed U.S. Pat. No. 4,716,438 issued Dec. 29, 1987 That is compatibly usable with the present system, if desired. Among many other examples of platen scanning electronic imaging systems per se are Xerox Corporation U.S. Pat. No. 4,295,167 or related U.S. Pat. No. 4,287,536. The terms copying and imaging are used interchangeably in this particular case.

Also as to specific hardware components of the subject apparatus, it will be appreciated that, as is normally the case, various such specific hardware components are known per se in other apparatus or applications, including that described in art cited herein, and need not be re-described herein. Particularly noted as to the disclosed RDH document handling system is Xerox Corporation U.S. Pat. No. 4,579,444, issued Apr. 1, 1986 to Pinkney and Sanchez (D/84074), and/or other RDH art cited therein. Said 4,579,444 patent is of appropriate background interest as illustrating the general nature of the specific embodiment of the disclosed document handler and platen. Some other examples of prior art recirculating document handlers are disclosed in U.S. Pat. Nos. 4,278,344 issued July 14, 1981 to R. B. Sahay; 4,270,746 issued June 2, 1981 to T. J. Hamlin, and 4,076,408 issued Feb. 28, 1978 to M. G. Reid, et al.. Also, in U.S. Pat. Nos. 4,176,945; 4,330,197, 4,446,733; and 4,428,667.

The disclosed set separator may be, for example, like Xerox Corporation U.S. Pat. No. 4,589,645 issued May 20, 1986 to M. J. Tracy. The document loading or document presence sensor may be the well know type illustrated herein, or as in U.S. Pat. No. 4,076,408 issued Feb. 28, 1978 to M. G. Reid, et al showing an optical emitter/detector 149, 151 in the document tray to detect the presence (loading) or absence of any documents in the tray. A similar disclosure is in U.S. Pat. No. 4,099,860 issued July 11, 1978 to J. L. Connin. Typically, as shown herein, such document tray "document presence" sensors are a conventional integral corner bottom light beam sensor unit, in which a light transmitter on the registration side wall slightly above the tray bottom transmits a light beam downwardly at an angle into an adjacent receiver or sensor in the tray bottom, and this light beam is occluded by any (even one) document sheet in the tray lying on the tray bottom. This "document presence" sensor information is normally used to tell the copier controller that the RDH tray mode of operation was in use, or, in clearing a jam, that there was a document to be removed and the reloaded with others in the document tray.

As noted in the prior art, as xerographic and other copiers and document imagers increase in speed, and become more automatic, it is increasing important to provide higher speed yet more reliable and more automatic handling of the plural document sheets being imaged, i.e., the input to the imager and/or copier.

In the description herein the term "document" or "sheet" refers to a usually flimsy sheet of paper, plastic, or other such conventional individual image substrate, and not to microfilm or electronic images which are generally much easier to manipulate. The "document" is the sheet (original or previous copy) being imaged, or copied in the copier onto the "copy sheet", which may be abbreviated as the "copy". Plural sheets of documents being imaged as a group in some desired related arrangement, even if not in an actual page order, or their copies, are referred to as a "set". A "duplex" document is a sheet desired to be copied on both sides, as opposed to a "simplex" or single side imaged document.

A specific feature of the specific embodiment disclosed herein is to provide, in a non-retard type bottom of stack sheet separating and feeding apparatus in which the bottom-most sheet is sequentially separated and fed out downstream by its downstream or lead edge from under the stack of sheets while the stack of sheets is generally supported on the bottom surface of a stacking tray thereof; the improvement comprising oriented fiber material mounted generally coplanar said bottom surface of said stacking tray and providing a substantial upstream area of said bottom surface of said stacking tray underlying and engaging a substantial upstream or trail edge area of said stack, said oriented fiber material having fibers which are predominantly angled upstream oppositely of said downstream sheet feeding direction to engage the trail or upstream edge area of the second-from-the-bottom sheet in said stack to resist its downstream movement as said bottom-most sheet is being initially separated and fed out.

Further specific features provided by the system disclosed herein, individually or in combination, include those wherein said oriented fiber material is a Nylon nap fabric with a permanent pile tuft orientation angle relative to said tray bottom and/or its backing substrate fabric plane of between 25 to 55 degrees, and/or has an approximately 520 Denier filament pile yarn, and/or wherein said oriented fiber material extends substantially entirely transversely across said bottom surface of said stacking tray underlying said upstream or trail edge area of said stack.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus the present invention will be better understood from this description of an embodiment thereof, including the drawing figures (approximately to scale), wherein:

Figure 1:
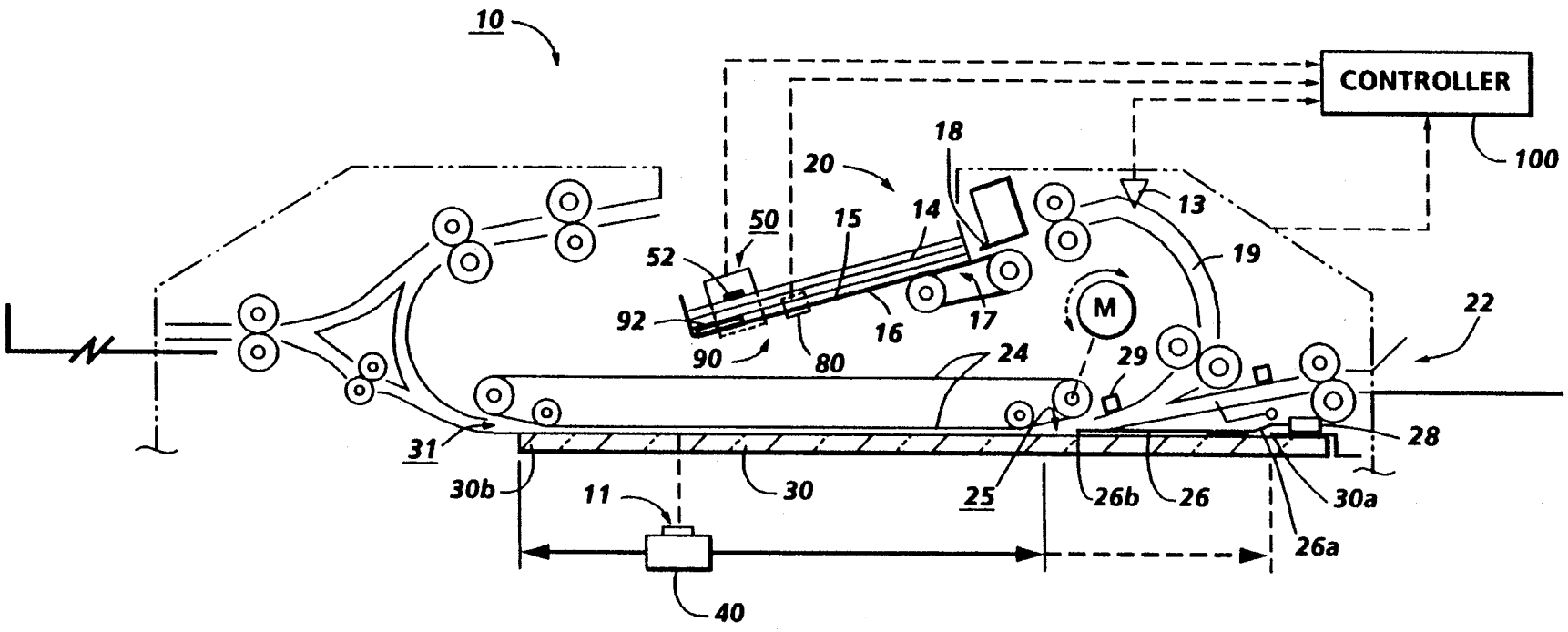
FIG. 1 is a schematic front view of one embodiment of the multifeed resistance system of the invention in an exemplary RDH document handler with a tray in which documents are stacked to be sequentially fed by a VCF sheet separator/feeder to an electronic imaging system.
Figure 2:
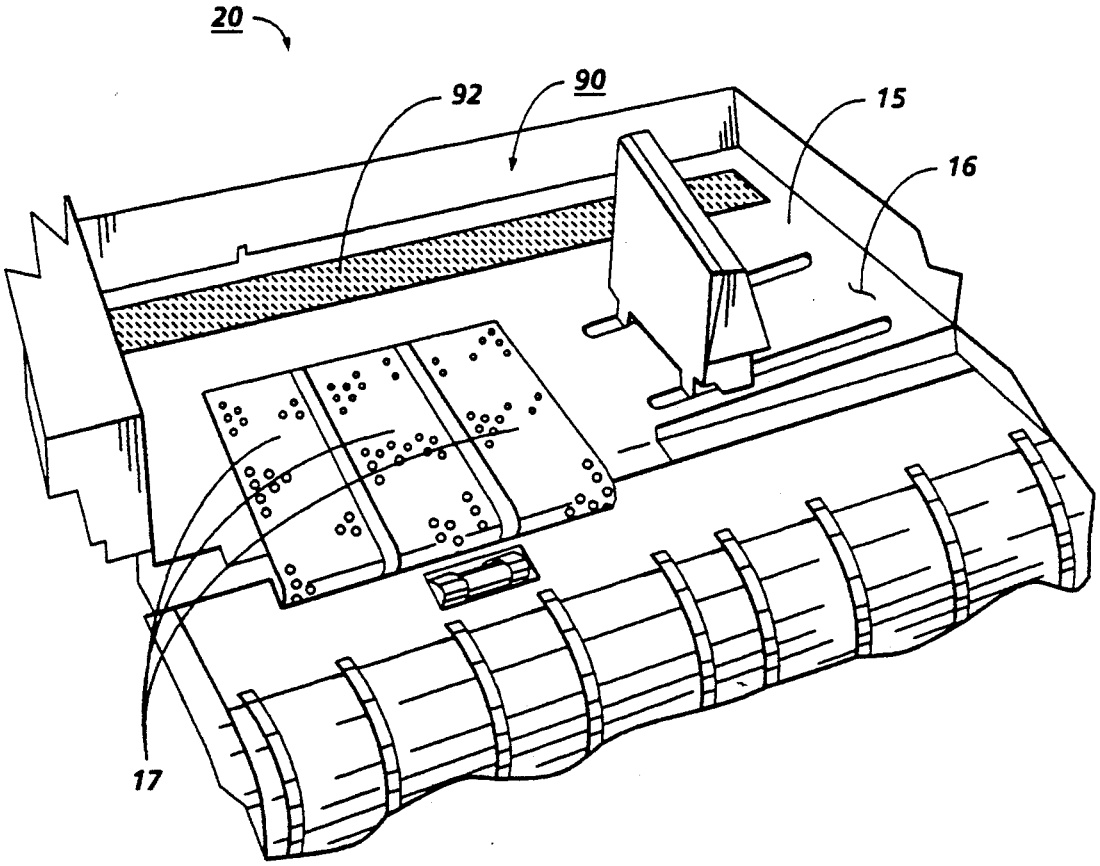
FIG. 2 is an enlarged partial schematic top view of a rear portion of the tray of the embodiment of FIG. 1.

Describing now in further detail the exemplary embodiment with reference to the Figures, this disclosed multifeed resistance system 90 is shown as a part of an exemplary integral document handling and imaging or copying system 10 with a recirculating document handler 20 shown by way of one example of a document handler incorporating the subject multifeed resistance system.

The RDH 20 may be otherwise conventional. Furthermore, the present system is applicable to numerous other sheet feeding systems, of which this is merely one example. Further details are described in the above-cited and other references, and need not be repeated herein. In this otherwise conventional recirculating document sheet handler 20, a stack 14 of individual flimsy document sheets are loaded onto the generally horizontal and planar bottom surface 15 in a restacking tray 16 to be fed seriatim from the bottom of the stack 14 by a known VCF vacuum belt and sheet separator/-feeder 17, including an air knife 18, adjacent the front or downstream edge of the stack 14, as shown. Each sheet, after it has been fed out to the copier platen and imaged or copied, may be returned via restacking feeder or transport which feeds the returning sheet in over the top of the stack 14 from the rear of the stack and releases the sheet to restack by settling down on top of the stack between aligning edge guides. Thus, the document sheets can be continuously recirculated, in the same order, as often as desired. Normally, as described in the cited and other art, the set 14 of normal sized documents is placed in the RDH 20 top document tray 16 as an unseparated stack. They are separated and sequentially fed from the tray 16 by the pneumatic bottom separator/feeder 17, and then counted by being fed past a conventional optical sheet edge sensor 13 in the sheet path. Here they are fed in the arcuate sheet path 19 to meet up with or merge with the alternate SADH document entrance 22 path, which also feeds documents, to the upstream end of the platen transport belt 24 and onto the platen 30 at an infeeding position 25 there. At this infeeding position 25 the document is initially fed onto the platen 30 and acquired in the nip therewith of the platen transport belt 24. Here that is substantially upstream of the upstream end **30*a* of the platen 30**.

The disclosed dual mode document registration document handler 20 has a special, different, mode of operation for large documents, e.g., 11" by 17" or A3 documents. In this particular document handler or feeder 20, large documents are preferably fed into the alternative side entrance or SADH slot 22 of the document handler 20, as compared to normal size documents which may be inserted either there or in the top or RDH stacking tray 21. However, this is merely exemplary, and the present invention is not limited to that particular type of document handler or document feeder.

This illustrated dual input RDH/SADH unit 20 is very much like that shown in the above-cited Xerox U.S. Pat. No. 4,579,444, issued Apr. 1, 1986, although FIG. 1 there is a reversed, mirror image, or rear view a compared to FIG. 1 here. Thus, this RDH/SADH 20, including its exemplary side or SADH entrance 22, may be basically as described in that patent, except as to the novel aspects described herein. Likewise, the RDH/SADH 20 and its drives and sensors are generally conventionally connected to and controlled by a conventional programmable controller 100, programmed as further described therein.

Just upstream of this document infeeding position 25 here is shown another conventional document edge optical sensor 29 (corresponding to reference 31 in the cited U.S. Pat. No. 4,579,444). In this particular RDH 20, an underlying pivotal infeeding area light reflective baffle 26, preferably liftable by a solenoid 28 closely overlays the platen 30 in the area thereof extending from the platen upstream edge **30*a* to the infeeding position 25. This infeeding area light baffle 26** is otherwise somewhat similar that shown and described in XDJ Vol. 7, No. 4., July/August 1982, p.275.

The disclosed electronic document imaging system 11 may be utilized in lieu of a conventional light-lens imaging system for electronic document imaging for a subsequent or integral printer. The electronic optical scanning system 11 reads document images on the imaging platen 30. As disclosed here schematically in FIG. 1, an exemplary electronic image scanning system 11 may be provided scanning from under the platen 30 with a scanner 40 which may be mounted on and reciprocally driven by a typical horizontal optical scanning carriage. The electronic image scanning system 11 here provides scanning up to the full length or the entire area of the platen 30, from the ends **30*a* to 30*b*, (see the movement arrows) to be able to image a document of any size which can be fitted onto the platen 30** upper surface. Conventionally, a document illuminating lamp and reflector light source may be located on the same scanning carriage.

The electronic imaging member 40 may be a conventional imaging bar or scan head CCD sensor array. Such electronic digitizing of the document image, for integral or separate digital copying, printing, facsimile transmission, and/or other digital image processing, enhancement, and/or manipulation, is rapidly becoming more important and critical, as compared to conventional copying with conventional light lens optical input, or the like. This is sometimes called an "EFE" or "electronic front end". Above-cited examples included Xerox Corporation U.S. Pat. Nos. 4,757,348, 4,295,167 and 4,287,536. The electronic image scanning may be bidirectional, as is known for example from Eastman Kodak U.S. Pat. No. 4,150,873 issued Apr. 24, 1979 to G. Dali and Xerox Corporation U.S. Pat. No. 4,205,350. Also, various electronic buffer and page collation systems may be connected to or made a part of the EFE, as disclosed in above-cited references, IBM Corp. U.S. Pat. Nos. 4,099,254 or 4,213,694; Eastman Kodak Canadian 1,086,231 or UK 1 531 401; the Xerox Corporation "1200" and "9700" printers, etc..

With document handler 20, normal sized documents are fed and registered and ejected entirely unidirectionally on the platen 30, in a generally conventional manner, with the servo-driven non-slip platen transport belt 24. Thus, normal size automatically fed documents are registered in a registration position entirely under the platen transport belt 24, downstream from the baffle 26.

However, with this particular exemplary document handler 20, a large oversize document (only) is initially fed onto the platen 30 in the same manner and direction but then is automatically treated differently, in accordance with being sensed as being oversized as it is fed in. The large document feeding continues until the downstream or lead edge area of the large document is overfed past the downstream end 30*b* of the platen (so that the lead edge area of the document actually briefly enters into the document exit or post-platen ejecting area 31). At that point in time, the trail edge of the oversized document has passed the upstream document edge sensor 29 and the downstream edge 26*b* of the baffle 26 in passing through the infeeding position 25 so that the length and oversized nature of that document is known by the copier controller 100. An oversized document includes any document which, at the feed-in point, exiting the infeeding position 25, would have any portion thereof extending beyond the downstream edge 30*b* of the platen 30, and would be imaged that way if handled as a normal document. In response to that oversize information, the document platen transport is automatically reversed, and the document is "backed-up" into a desired copying position registered relative to the upstream platen edge 30*a* under the infeeding baffle 26. Coordinated lifting of the baffle 26 end 26*b* may be provided by a solenoid 28.

The RDH 20 here also conventionally includes a set separator unit 50 with an integral finger, arm or bail 52, and a document presence sensor 80, connected to the controller 100.

Turning now to the specific system 90 disclosed herein, this disclosed mutifeed resistance system 90 is a simple and low cost combination with and modification of known VCF type bottom sheet separator/feeders. As noted, VCF is a common abbreviation for a vacuum corrugating feeder 17 in which the stack 14 of sheets is fluffed by an air knife 18 and the front area of the bottom sheet 98 is pulled down by the vacuum and out from the bottom of the stack 14 with the corrugating vacuum belt feeder 17 to separate the bottom sheet 98 from the rest of the stack 14 and fed it out of the tray 16. Such VCF feeders are preferable for document feeding since they desirably avoid using any retard pads for sheet separation, unlike conventional retard type feeders. This avoid smearing or other damage to the documents. It is especially usable with a recirculating type document handler (RDH) for an imager for a copier, printer, or other document imaging system, as discussed in the art. Such VCF feeders heretofore have avoided or sought to reduce drag or resistance to the feeding out of the document sheet by the VCF, which was considered to interfere with the VCF functioning. However, in the present system 90, a particular type and limited area of application special multifeed resisting or retarding member 92 has been found to be effective in resisting multifeeds, yet not interfere with effective bottom sheet feeding.

Figure 3:
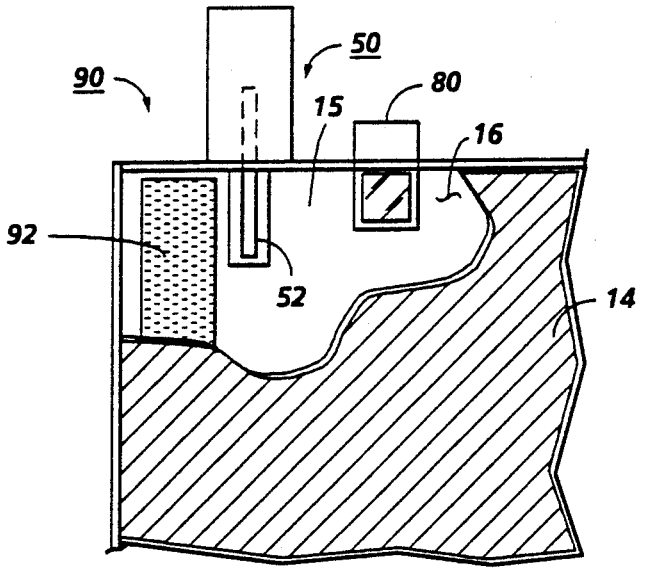
FIG. 3 is a highly enlarged partial front cross-sectional view of a rear portion of the tray of the embodiment of FIGS. 1 and 2 illustrating the action of the special retarding member there on sheets being fed; and, FIG. 4 is a perspective top/front view of the tray area of the embodiment of FIGS. 1-3.
Figure 4:
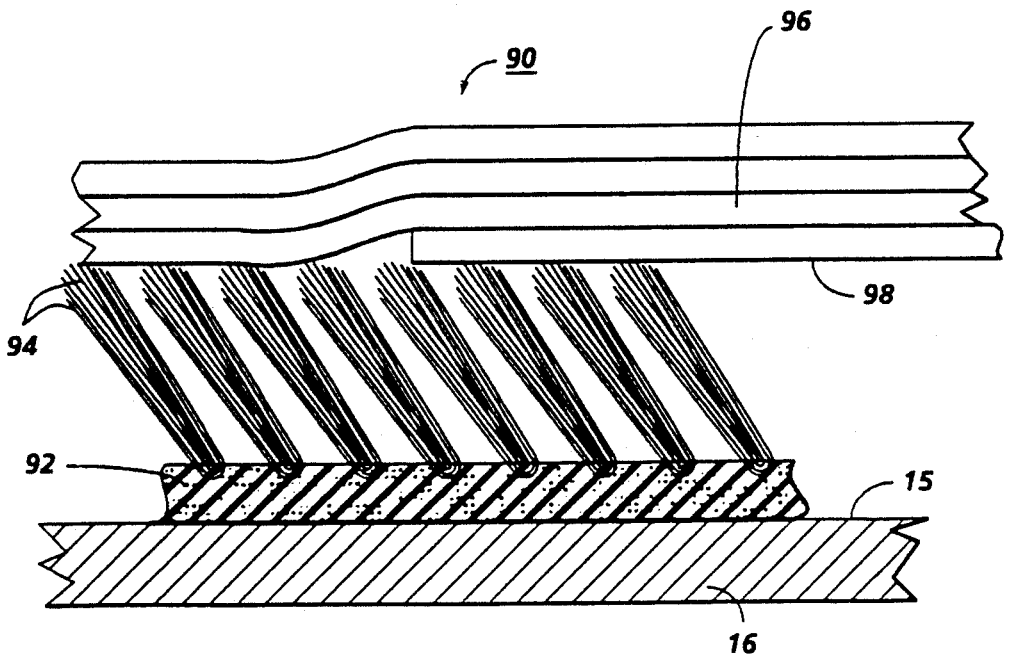

The disclosed separator/feeder 20 modification of the disclosed multifeed resistance system 90 comprises one or more mats or pads of a special double feeding resistance member 92 overlying, as shown, a substantial portion of, and extending transversely across, the rear or upstream portion of the stack supporting bottom surface 15 of the stacking tray 16. This double feeding resistance member 92 is a special oriented (one-way) fiber material underlying the rear area of the stack 14. The fibers 94 of the double feeding resistance member 92 are angled upstream (oriented towards the rear of the tray 16). I.e., the nap of the fibers 94 is opposing or contrary to the sheet feeding direction. This is a passive, fixed, pad or pads substantially coplanar with the tray bottom 15. As shown greatly enlarged in FIG. 3, these fibers 94 frictionally engage and drag on the trail or upstream edge area of the second-from-the-bottom sheet 96 as the bottom-most sheet 98 is being initially separated from and fed from the bottom of the sheet stack 14. That bottom sheet 98 is engaged and pulled forward or downstream for separation and feeding by the VCF vacuum belt and air knife sheet separator/-feeder 17 at the front, lead, or downstream edge area of the stack 14, as shown. This pulling out of the bottom sheet 98 from under the overlying weight of the stack by the separator/feeder 17 (even though the stack is fluffed or partially lifted by the air flow directed against it by the air knife 18) tends to pull out with it the directly overlying sheet 96, due to friction between these two adjacent sheets 98 and 96. The upstream oriented fibers 94 engage the initially exposed trail or upstream edge area of the sheet 96 during the initial separation movement to resist further downstream movement of the sheet 96 as the bottom-most sheet 98 is being further separated therefrom and fed out downstream from underneath the sheet stack 14. This resists the sheet 96 being carried along with the sheet 98, and fed out therewith, which would be a double feed. That in turn also impedes the carrying out of additional sheets immediately above the feeding sheet 98, which would be a further multifeed.

This fixed oriented fiber material pad 92 may be simply cut to size and glued on to the tray bottom 15, with self-stick or other conventional adhesive. That is of course much cheaper and simpler than using active and/or intermittently operated pneumatic (vacuum) or electrostatic sheet trail edge holding members at that location to try to engage the sheet 96.

An example of such a suitable special oriented (one-way) fiber 94 material mat or pad 92 (which may be called a fabric or cloth or grass material), is "Climber P" Nylon fabric, sold as a finished fabric by Collins & Aikman Corporation Industrial Fabrics, 1803 North Main Street, Roxboro, N.C., U.S.A., 27573, with an average pile tuft orientation angle from the horizontal or backing fabric plane of 25 to 55 degrees and a latex back coating, a trilobal filament shape, and a 37 filament count pile yarn. The fiber or pile therefore may be yarn type 6R70 of 520 Denier/37 filament Nylon supplied by Allied Fibers Inc. Suite 108 Friendship Central Park, Greensboro, N.C., U.S.A., 27409. [Other material of this general type is 3M Company Brushlon TM Fiber Short Trim product No. 321B (tilted fibers), or modifications thereof.]

If air knife fluffing of the document stack is not desired during the initial bottom sheet separation, to increase the stack normal force (downward stack weight pressure) on the double feeding resistance member 92, then the air supply and could be briefly temporarily interrupted, although that is less desirable. Preferably, instead, the air knife level and/or angle is such that the leading or downstream edge area of the stack, but not the rear or upstream edge area of the stack, is effectively partially pneumatically levitated by the air knife effect. Thus, substantially the full weight of the stack presses the two bottom-most sheets against the double feeding resistance member 92. This is inherent in some known air knife systems per se.

If desired, additional such material 92 can also be placed on the vertical rear, back or upstream wall of the tray 16, with the nap or fiber angle downwardly oriented, for the different purpose of helping to control stack flutter and resisting wall climbing (a ratcheting effect).

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a non-retard type bottom of stack sheet separating and feeding apparatus in which the bottom-most sheet is sequentially separated and fed out downstream by its downstream or lead edge from under the stack of sheets while the stack of sheets is generally supported on the bottom surface of a stacking tray thereof; the improvement comprising oriented fiber material mounted generally coplanar said bottom surface of said stacking tray and providing a substantial upstream area of said bottom surface of said stacking tray underlying and engaging a substantial upstream or trail edge area of said stack, said oriented fiber material having fibers which are predominantly angled upstream oppositely of said downstream sheet feeding direction to engage the trail or upstream edge area of the second-from-the-bottom sheet in said stack to resist its downstream movement as said bottom-most sheet is being initially separated and fed out.

2. The bottom of stack sheet separating and feeding apparatus of claim 1, wherein said oriented fiber material is a Nylon nap fabric.

3. The bottom of stack sheet separating and feeding apparatus of claim 1, wherein said oriented fiber material is a Nylon nap fabric with an average pile tuft orientation angle from the plane of said bottom surface of said stacking tray of from approximately 25 to 55 degrees.

4. The bottom of stack sheet separating and feeding apparatus of claim 1, wherein said oriented fiber material is a Nylon nap fabric with a permanent pile tuft orientation angle relative to a backing substrate fabric plane of between 25 to 55 degrees and an approximately 520 Denier filament pile yarn.

5. The bottom of stack sheet separating and feeding apparatus of claim 1, wherein said oriented fiber material extends substantially entirely transversely across said bottom surface of said stacking tray underlying said upstream or trail edge area of said stack.

6. The bottom of stack sheet separating and feeding apparatus of claim 5, wherein said oriented fiber material is a Nylon nap fabric with an average pile tuft orientation angle from the plane of said bottom surface of said stacking tray of from approximately 25 to 55 degrees.

* * * * *